United States Patent [19]

Thompson

[11] 4,098,505

[45] Jul. 4, 1978

[54] LAMINATED FIBER SPORT RACKET

[76] Inventor: Dale F. Thompson, 5215 Chollas Pkwy., San Diego, Calif. 92105

[21] Appl. No.: 738,873

[22] Filed: Nov. 4, 1976

[51] Int. Cl.[2] ..... A63B 49/10

[52] U.S. Cl. ..... 273/73 F; 273/DIG. 7; 273/DIG. 23; 156/245

[58] Field of Search ..... 273/67 R, 67 A, 73 R, 273/73 C, 73 D, 73 F, 73 K, 76, 82 R, 96 D, DIG. 7, DIG. 23; 280/610; 272/62, 63, 111

[56] References Cited

U.S. PATENT DOCUMENTS

| | | | |
|---|---|---|---|
| 3,483,055 | 12/1969 | Eshbaugh | 273/DIG. 7 |
| 3,787,051 | 1/1974 | Johns | 273/73 F |
| 3,827,689 | 8/1974 | Hyde | 272/63 |

FOREIGN PATENT DOCUMENTS

| | | | |
|---|---|---|---|
| 1,180,866 | 1/1959 | France | 273/73 F |
| 1,940,524 | 2/1971 | Fed. Rep. of Germany | 273/73 F |
| 585,489 | 2/1947 | United Kingdom | 273/DIG. 7 |

*Primary Examiner*—Richard J. Apley
*Attorney, Agent, or Firm*—Laurance E. Banghart

[57] ABSTRACT

An improved frame, and manufacturing method, for sport rackets used in games such as racquet ball, tennis, court tennis, squash, squash tennis, badminton, and lacrosse. A single laminated piece forms the major portion of both the head and the handle. The laminated piece consists of laminae of fibrous tape and laminae of thermoplastic.

6 Claims, 9 Drawing Figures

LAMINATED FIBER SPORT RACKET

BACKGROUND OF THE INVENTION

Sport rackets used in games such as racquet ball, tennis, court tennis, squash, squash tennis, badminton, and lacrosse can be separated into two major groups: metal frames, and wooden or filled plastic frames. Many people prefer the metal rackets, and many people prefer the wooden or plastic variety. It is impossible to quantitatively define the physical properties of the various rackets which cause this difference in preference; but it has been shown experimentally that by stiffening a plastic frame, while keeping essentially the same weight and cross-section, most people consider that the racket has been improved. Typically the statement is: "the power of steel with the control and impact damping of wood."

SUMMARY OF THE INVENTION

It is, then, an object of this invention to make a sport racket of cross-section and weight typical of plastic and wooden rackets, but with considerably more stiffness and strength. A reinforced plastic racket, rather than a reinforced wooden racket, is preferable due to lower cost materials, greater uniformity, and lower cost manufacturing methods. Considering the requirements, a primary figure of merit for materials to be considered for reinforcement is: strength divided by density.

A modern class of fibrous materials is renowned for this very figure of merit. For example, monofilament boron has twice the strength (modulus of elasticity) of steel and $\frac{1}{4}$ the density; it has 60 times the strength of wood or filled plastic, and only twice the density. Two disadvantages of boron fiber are its high cost and the fact that it is not acceptable at any outside surface; that is to say, it is not machinable. Graphite yarn tapes are not as strong as boron tapes, but are machinable and cost considerably less.

Lower strength aramid fibrous tapes, under the commercial name "Kevlar," have been produced. An important advantage of this material is that it produces a racket with high impact damping. It is particularly effective when used in combination with the stronger boron or graphite tapes.

A single laminated piece forming the major portion of both the head and the handle, comprising alternating laminae of fibrous tape and thermoplastic, has proven to be the optimum structure for a reinforced plastic sport racket frame. It has been determined experimentally that with the inclusion of 8 to 20% (by volume) of the fibrous materials discussed above the desired stiffening and strengthening is accomplished.

The prefered thermoplastic is polycarbonate, chosen for its strength, thermal bonding characteristics, machinability, and appearance. Obviously there is a variety of thermoplastics that could perform with similar characteristics.

Another object of this invention is to manufacture the above described piece repeatably and at lowest possible cost. To accomplish this, thermosetting-resin impregnated fibrous tape is normally used, and the thermoplastic laminae and fibrous tape laminae are layed up around a metal preform tool. The piece is then placed into a female tool with expanding inner plug. The proper temperature and the expansion of the plug produce the high strength laminated piece.

A major advantage of this method lies in the fact that the laminae are not handled at high temperature, and the compression occurs automatically and repeatably. The tool and plug can be used repeatedly.

BRIEF DESCRIPTION OF THE DRAWINGS

The invention will be better understood by reference to the following figures in which.

DETAILED DESCRIPTION

Figure 1:
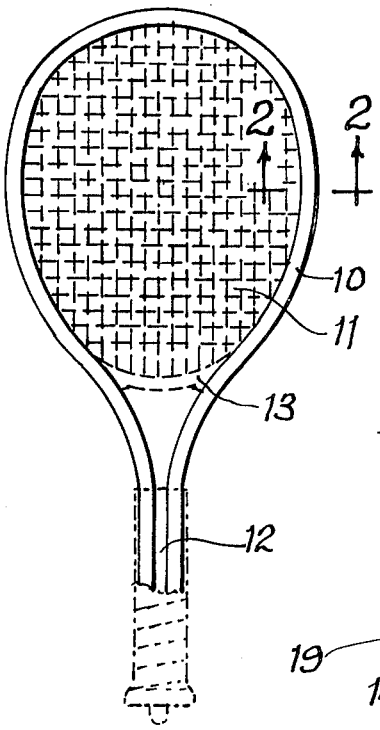
FIG. 1 is a plan view of the sport racket, including a view of the bottom of the handle with wrappings removed.

Referring now to FIG. 1, a typical sport racket, using the structure of this invention, is shown. With the exception of the netting 11, the frame includes all the other elements 10, 12, and 13. The size, shape, and thickness of the frame will vary according to the custom of the game for which the racket is intended.

This invention relates to the improvement of sport racket frames that use a single piece 10, with a short throat piece 13, to form the head of the racket frame, and, with a sandwiched filler piece 12 and wrappings, the handle of the racket frame. More particularly this invention improves the piece 10 with improved materials, configuration of materials, and method of manufacture.

Figure 2:
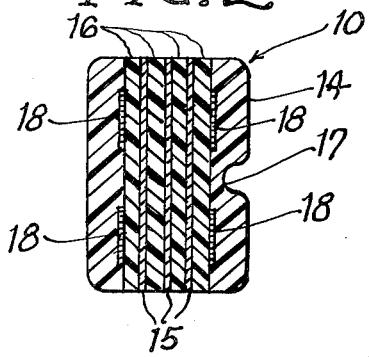
FIG. 2 is a detailed elevation section view of the racket frame, taken approximately on the line 2—2 of FIG. 1.

FIG. 2 shows the single piece, as laminated, with alternating laminae of thermoplastic 14 and 16 and fibrous tape 15 and 18. The outside thermoplastic lamina 14 is formed with a channel 17 in the center where the strings of the racket pass through the racket frame.

Figure 3:
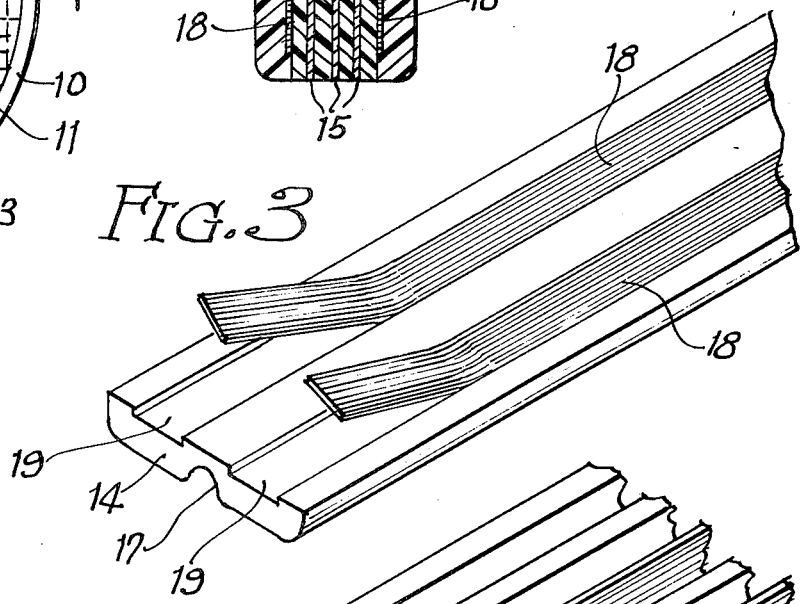
FIG. 3 is a detailed perspective view of the formed outside thermoplastic lamina of the laminated piece that constitutes the major portion of the racket frame, along with one lamina of fibrous tape in two pieces.

FIG. 3 shows the outside thermoplastic lamina with other channels 19 to contain a fibrous lamina of two tapes 18 so that the tapes cannot reach the edges nor the center of the laminated piece. Since this lamina is necessarily formed to obtain the center channel, the addition of the channels to contain fibrous tape does not appreciably affect the cost of the lamina.

The outer and inner laminae affect stiffness of the frame more than do the laminae toward the center of the piece. Therefore the inner lamina is formed with channels 19 like the outside lamina, and a highly cost effective combination uses high strength, but nonmachinable, boron fiver in these channels; along with lower strength, lower cost, and machinable fibrous tapes as full width inner laminae (15 of FIG. 2 and FIG. 4).

Figure 4:
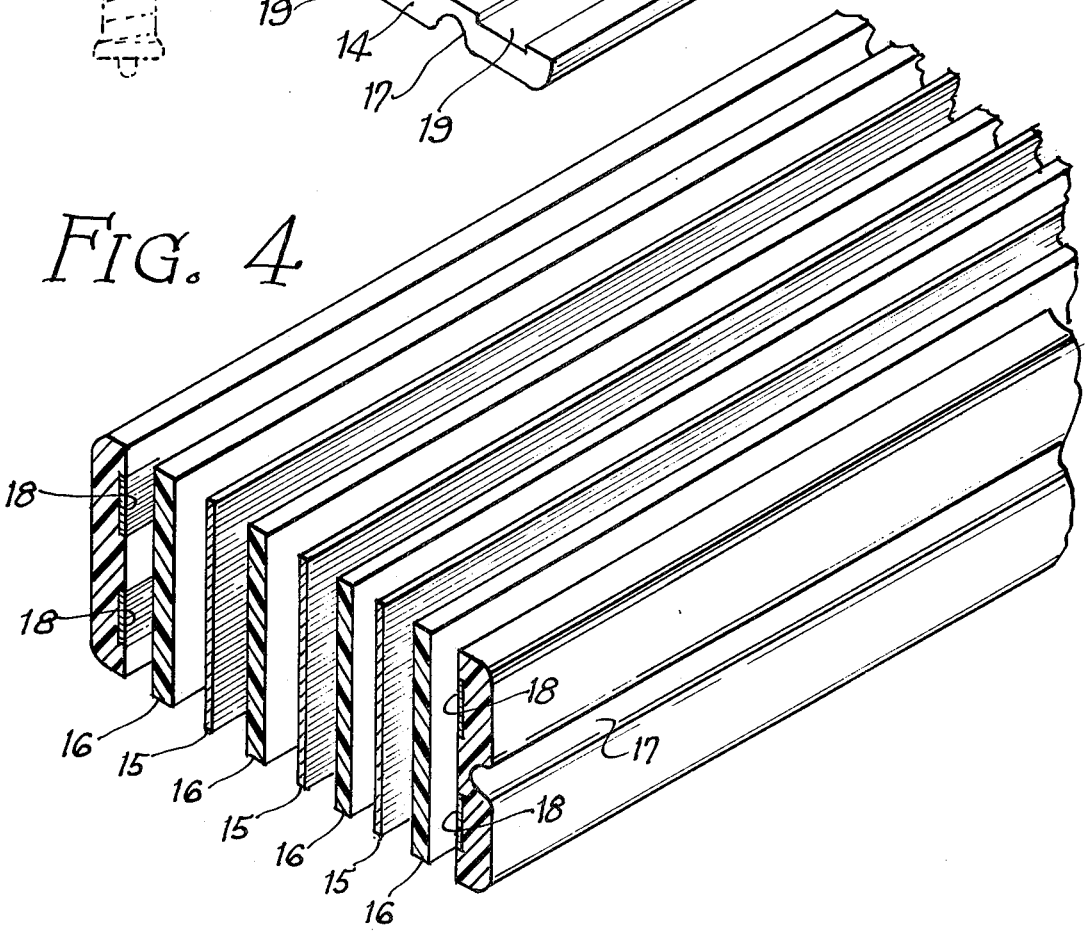
FIG. 4 is a detailed perspective exploded view of the laminated piece that constitutes the major portion of the racket frame.

FIG. 4 shows the laminae in exploded form. The thickness, width, and number of laminae will vary according to the requirements placed on racket frames by the various games. The number of laminae shown here is typical for racquet ball rackets and tennis rackets.

Figure 5:
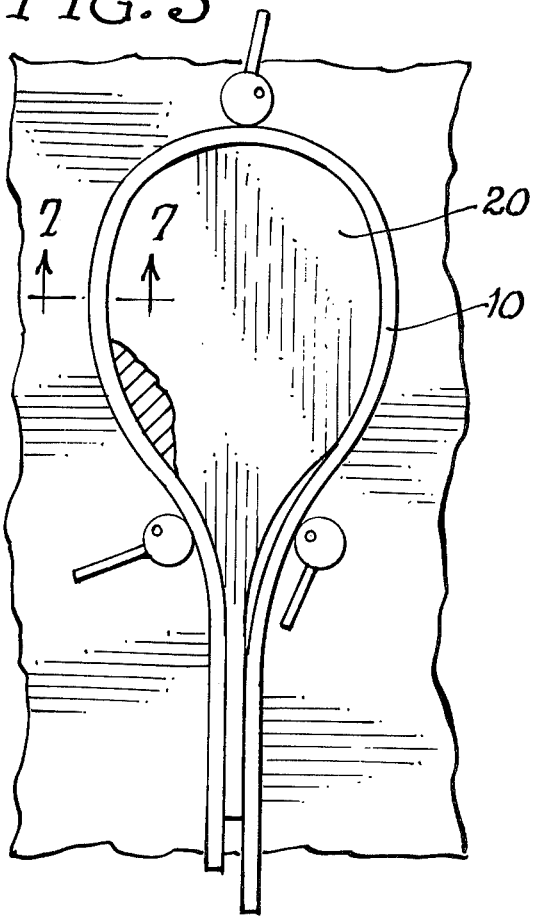
FIG. 5 is a plan view of the laminae layed up around the metal preform tool.
Figure 7:
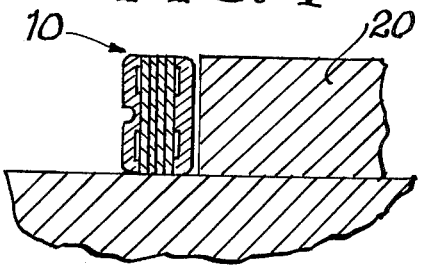
FIG. 7 is a detailed elevation section view of the laminae layed up around the metal preform tool, taken approximately on the line 7—7 of FIG. 5.

FIG. 5 and FIG. 7 show the assembled laminae 10 being layed up around a metal preform tool 20 to be lightly bonded in the approximate final shape of the laminated piece.

Figure 6:
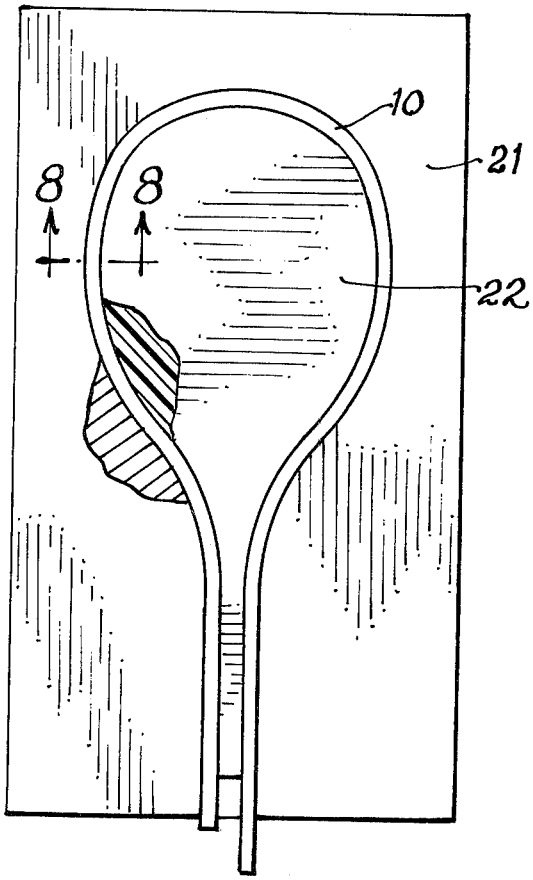
FIG. 6 is a plan view of the laminae in the female tool with plug.
Figure 8:
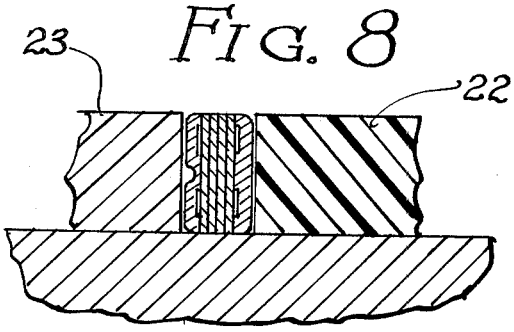
FIG. 8 is a detailed elevation section view of the laminae in the female tool with plug, taken approximately on the line 8—8 of FIG. 6.

FIG. 6 and FIG. 8 show the shaped and lightly bonded piece 10 in a metal female tool 21 and 23 which determines the desired final outer shape of the piece. The tool has an inner plug 22 of silicone rubber or similar material. The piece and the rubber plug make a snug fit in the female tool.

Figure 9:
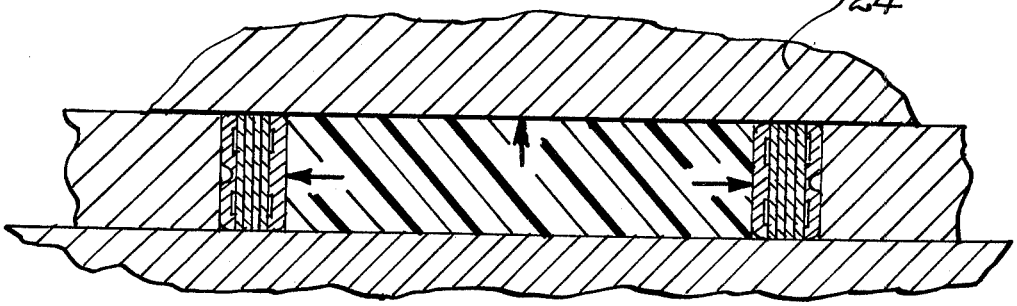
FIG. 9 is an elevation section view of the laminae in the female tool with plug and cover plate.

FIG. 9 shows the shaped and lightly bonded piece in the metal female tool with plug and cover plate 24. The cover plate, which may be part of a platen press, keeps the plug from expanding upward and thus not applying pressure to the laminae. With the cover in place the heated plug applies pressure equally to the female tool, the cover plate, and the laminae (arrows in FIG. 9).

The tool with the piece inside is heated to the critical temperature at which the laminae bond together. Fusion bonding (welding) takes place at the interfaces between the laminae, and the individual laminae can be seen in the finished frame.

In order for effective bonding to take place, a moderate amount of pressure is necessary, both when the critical temperature is reached and while the piece is cooled well below the critical temperature. Silicone rubber has a high coefficient of thermal expansion, and, when used as a tooling plug, provides the necessary pressure to laminate the piece.

It has been found experimentally that when RTV (room temperature vulcanizing) silicone rubber is used as the tooling plug and polycarbonate is used as the laminae 320°–350° F. is the appropriate critical temperature. The method could obviously be used with different, but similar, materials for either the tooling plug or the thermoplastic laminae. The critical temperature would vary somewhat in those cases.

The female tool with the laminating piece inside is cooled, the silicone rubber contracting. After cooling, the now laminated piece is easily removed. The tool and plug can be used repeatedly.

What I claim is:

1. An improved frame for sport rackets, of the type having frame and strings, and used in games such as racquet ball, tennis, and badminton, said frame having a laminated piece formed to constitute the head of the frame and both sides of the handle, the laminated piece comprising a plurality of thermoplastic laminae and at least one fibrous tape lamina, said strings passing through the longitudinal axes of all of said laminae, the improvement comprising: a thermoplastic lamina formed before lamination with two longitudinal channels, one on each side of the plane of said strings; and two fibrous tape laminae contained in said channels, the thermoplastic lamina and the two fibrous tape laminae forming a combination having a rectangular cross section.

2. A frame for sport rackets as in claim 1 wherein said contained fibrous tape laminae comprise boron fiber.

3. An improved frame for sport rackets, of the type having frame and strings, and used in games such as racquet ball, tennis, and badminton, said frame having a laminated piece formed to constitute the head of the frame and both sides of the handle, the laminated piece comprising at least three thermoplastic laminae and at least one fibrous tape lamina, said strings passing through the longitudinal axes of all of said laminae, the improvement comprising: an outermost and an innermost thermoplastic lamina each formed before lamination with two inwardly facing longitudinal channels, one on each side of the plane of said strings; two fibrous tape laminae contained in said channels, each thermoplastic lamina along with its two associated fibrous tape laminae forming a combination having a rectangular cross section; and at least one interior thermoplastic lamina having a rectangular cross section.

4. A frame for sport rackets as in claim 3 wherein said contained fibrous tape laminae comprise boron fiber.

5. An improved frame for sport rackets, of the type having frame and strings, and used in games such as racquet ball, tennis, and badminton, said frame having a laminated piece formed to constitute the head of the frame and both sides of the handle, the laminated piece comprising at least three thermoplastic laminae and at least one fibrous tape lamina, said strings passing through the longitudinal axes of all of said laminae, the improvement comprising: an outermost and an innermost thermoplastic lamina each formed before lamination with two inwardly facing longitudinal channels, one on each side of the plane of said strings; two fibrous tape laminae contained in said channels, each thermoplastic lamina along with its two associated fibrous tape laminae forming a combination having a rectangular cross section; at least one interior thermoplastic lamina having a rectangular cross section; and at least one fibrous tape lamina having the same width as said thermoplastic laminae.

6. A frame for sport rackets as in claim 5 wherein said contained fibrous tape laminae comprise boron fiber.

* * * * *